US005453668A

United States Patent [19]

Chow

[11] Patent Number: 5,453,668

[45] Date of Patent: Sep. 26, 1995

[54] METHOD AND CIRCUITRY FOR PRODUCING DYNAMIC ILLUMINATION OF DISCHARGE LAMP

[76] Inventor: Shing C. Chow, 12A Suffolk Road, Kowloon Tong, Kowloon, Hong Kong

[21] Appl. No.: 216,645

[22] Filed: Mar. 23, 1994

[51] Int. Cl.[6] ..... H05B 37/02

[52] U.S. Cl. ..... 315/307; 315/246; 315/224; 315/219

[58] Field of Search ..... 315/291, 307, 315/DIG. 4, DIG. 5, DIG. 7, 169.4, 248, 246, 219, 224, 208, 209 R

[56] References Cited

U.S. PATENT DOCUMENTS

| | | | |
|---|---|---|---|
| 4,645,979 | 2/1987 | Chow | 315/169.1 |
| 4,719,389 | 1/1988 | Miesterfeld | 315/169.4 |
| 4,742,278 | 5/1988 | Iannini | 315/248 |
| 4,933,612 | 6/1990 | Bonin | 315/219 |

FOREIGN PATENT DOCUMENTS

| | | | |
|---|---|---|---|
| 4098794 | 3/1992 | Japan | 315/219 |
| 2120870 | 12/1983 | United Kingdom | 315/219 |

*Primary Examiner*—Robert J. Pascal
*Assistant Examiner*—Michael Shingleton
*Attorney, Agent, or Firm*—Knobbe, Martens, Olson & Bear

[57] ABSTRACT

A sweeping signal generator generates sequences of logic-level pulses of variable pulse-width. The logic-level pulses are amplified and applied to the electrodes of a discharge lamp. The illumination region of the discharge lamp is dynamically varied in size by dynamically varying the widths of the pulses, thereby producing sweeping effects and other display effects. In the preferred embodiment the sweeping signal generator comprises a microprocessor, a counter and a tri-state buffer. The microprocessor periodically loads the counter with an initial count value to initiate a pulse at the output of the tri-state buffer. The value loaded into the counter controls the duration of the pulse. Pulses are then amplified using a circuit which comprises a switching transistor, a power source, and a step-up transformer.

23 Claims, 8 Drawing Sheets

AMPLIFIED SWEEPING SIGNAL

LOGICAL-LEVEL SWEEPING SIGNAL

AMPLIFIED SWEEPING SIGNAL

METHOD AND CIRCUITRY FOR PRODUCING DYNAMIC ILLUMINATION OF DISCHARGE LAMP

FIELD OF THE INVENTION

This invention relates to discharge lamps for which the illumination region can be dynamically varied in size to produce a "moving" or "sweeping" display. In particular, this invention relates to a circuit and method for controlling the size of the illumination region of a discharge lamp.

BACKGROUND OF THE INVENTION

U.S. Pat. No. 4,645,979 to the applicant describes a display device consisting of a discharge lamp for which the size of the illumination region can be dynamically controlled in order to create a "moving" or "sweeping" effect. The discharge lamp is comprised of an elongated glass tube containing an inert gas such as neon. The discharge lamp has a first electrode internal to the tube and a second electrode in the form of a conductive film on the exterior surface of the tube. A conductive film of tin oxide is produced by spraying an aqueous solution of tin halide onto the exterior surface of the tube at a temperature of 500 to 700 degrees Celsius.

The sweeping effect is produced by applying a sweeping signal to the electrodes of the discharge lamp, wherein the sweeping signal is a periodic sequence of pulses of increasing amplitude. As the pulses increase in amplitude the illumination region of the discharge lamp increases in size. The sweeping display produced is useful, for example, for conveying information pertaining to motion or direction, or for drawing attention to the a textual display formed by multiple discharge lamps.

In order to generate the sweeping signal, a pulse generator is used to generate a pulse signal in the range of 300 Hz to 20 kHz, and a sawtooth waveform generator is used to vary the amplitude of the pulses at a relatively slow rate. The resulting periodic sequence of pulses of increasing amplitude is applied to the primary winding of a step-up transformer. The step-up transformer boosts the amplitude of the pulses to the range of 500 to 1200 volts, and the resulting signal is applied to the electrodes of the discharge lamp.

This art prior system requires a variable voltage source such as a sawtooth waveform generator to vary the pulse amplitude. A microprocessor can be used to generate the variable voltage waveform, but a digital-to-analog converter is generally needed to convert the binary output of the microprocessor into a corresponding voltage waveform.

An objective of the invention, therefore, is to eliminate the need for a variable voltage source, and to thereby reduce the cost and complexity of the circuit for generating the sweeping signal. A further objective of the invention is to produce a sweeping signal capable of generation using ordinary logic-level components. A further objective of the invention is to provide two alternative embodiments of the exterior electrode of the discharge lamp.

SUMMARY OF THE INVENTION

It was heretofore believed that in order to vary the illumination region and thereby produce the described sweeping effect, the pulses of the sweeping signal applied to the discharge lamp had to vary in amplitude. A variable voltage source such as a sawtooth waveform generator has therefore been used to vary the amplitude of the pulses.

It has now been discovered that the illumination region of the discharge lamp can be varied by progressively varying the pulse-width of the sweeping signal without changing the amplitude of the pulses. As with the sequence of pulses of successively increasing amplitude described above, constant amplitude pulses of successively increasing duration produce a successively increasing illumination region. The desired sweeping effect can thus be produced by applying periodic sequences of pulses of constant amplitude and progressively increasing pulse-width to the electrodes of the discharge lamp. The brightness of the display can be controlled by varying the frequency of the pulses.

The advantage of using this variable pulse-width sweeping signal is that it is well-suited for generation using a microprocessor in combination with dedicated digital logic circuitry. No variable voltage source or waveform generator is needed. The cost and complexity of the circuit for generating the sweeping signal is therefore reduced.

In the preferred embodiment, the variable pulse-width sweeping signal is generated as a logic-level signal by a sweeping signal generator. This logic-level sweeping signal is applied to the base of a switching transistor to reproduce the sweeping signal across the primary winding of a step-up transformer. The variable pulse-width sweeping signal is thereby produced at an amplified voltage at the secondary winding of the step-up transformer. This amplified sweeping signal is applied to the electrodes of the discharge lamp.

Two embodiments of the sweeping signal generator are presented. In the first embodiment, the variable pulse-width sweeping signal is generated as the output of a tri-state buffer. The tri-state buffer has an input connected to a 5 volt source, and an output that is connected to a pull-down resistor. The output control line of the tri-state buffer is controlled by a microprocessor and a binary counter. The microprocessor periodically loads the counter with a value which specifies the duration for which the output of the tri-state buffer is enabled. Once the counter reaches a predetermined value, the output is tri-stated, and the output line is pulled low by the pull-down resistor. A pulse is thereby generated having a pulse-width that is determined by the initial counter value. The microprocessor repeats this sequence using progressively larger or smaller counter values to produce the variable pulse-width sweeping signal.

In the second embodiment of the sweeping signal generator, a microprocessor writes 8-bit patterns to two 8-bit latches. The outputs of these two latches form sixteen sweeping-signal lines for separately controlling sixteen discharge lamp circuits. After writing a pattern to one of the latches, the microprocessor writes a value to a counter to control the pulse-width of pulses generated on the signal lines selected by the pattern.

Another aspect of the present invention involves two alternative methods for producing an exterior electrode of the discharge lamp. The first alternative method involves the application of a conductive paint to the exterior surface of the tube. The second alternative method involves the application of a conductive wire to the outer surface of the tube. Both alternative methods are considerably simpler than the method previously disclosed by the above-referenced patent to the applicant.

BRIEF DESCRIPTION OF THE DRAWINGS

In the drawings, like reference numbers indicate identical or functionally similar elements. Additionally, the left-most digit of a reference number identifies the drawing in which the reference number first appears.

DETAILED DESCRIPTION OF THE INVENTION

Figure 1:
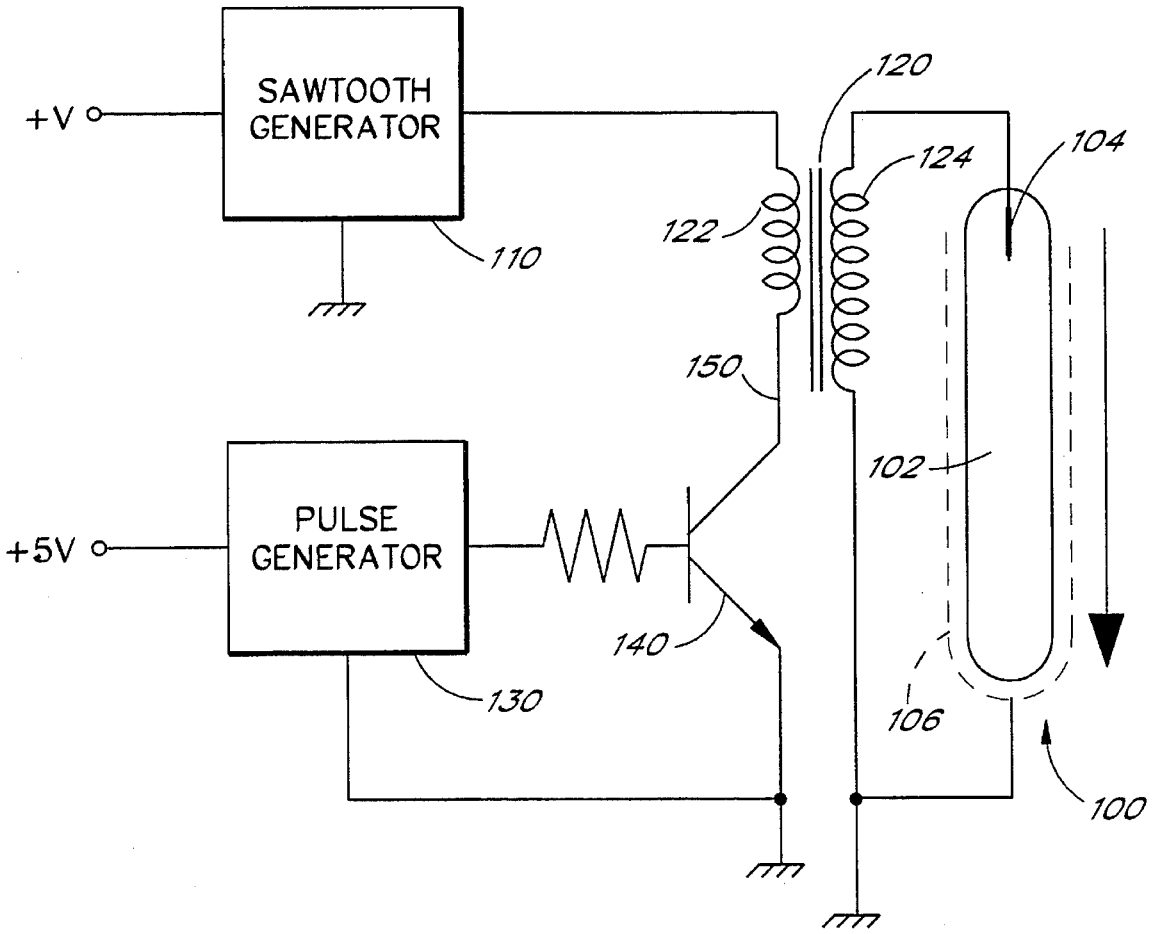
FIG. 1 (PRIOR ART)
FIG. 1 illustrates a prior art circuit for generating a sweeping signal and for applying the signal to a discharge lamp.

In order to fully explain one of the problems overcome by the present invention, the prior art will be explained with reference to FIGS. 1 and 2.

The apparatus disclosed by U.S. Pat. No. 4,645,979 to the applicant for generating a sweeping display is shown in FIG. 1. The discharge lamp 100 is made from an elongated, glass discharge tube 102 which contains an inert gas such as neon or xenon. The discharge tube 102 may be straight (as shown), or may have one or more curved portions. For example, the tube may form the shape of the letter "S," or the shape of another letter of the alphabet. Multiple tubes can thereby be used, for example, to form a textual display.

The discharge lamp 100 has an internal electrode 104 located within the hollow portion of the discharge tube 102. The exterior of the discharge tube 102 is coated with a conductive film 106 to produce the second electrode 106. The conductive film 106 is composed of a substance such as tin oxide, which is produced as described above.

The discharge lamp 100 is coupled to a circuit for generating a sweeping signal via a step-up transformer 120. A sawtooth generator 110 applies a low frequency sawtooth voltage waveform (typically in the range of 1 to 5 Hz) to the primary winding 122 of the transformer 120. The period of this sawtooth waveform is the period at which the display sweeps. The sawtooth waveform varies between a few volts at its minimum and +V volts at its peak, where V is typically about 13.8 volts.

A pulse generator 130 applies a relatively high frequency sequence of pulses of fixed pulse-width to the base of the transistor 140, thereby opening and closing a circuit between the node 150 and ground. This pulse signal serves to strobe the discharge lamp on and off at a rate which cannot be seen, typically in the range of several hundred to several thousand cycles per second.

Figure 2A:
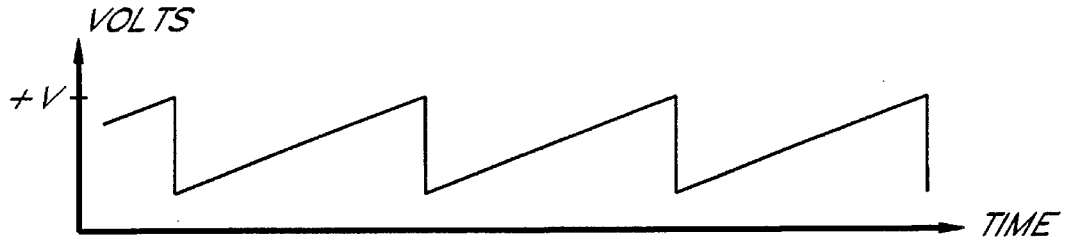
FIG. 2A (PRIOR ART)
FIG. 2A illustrates a sawtooth waveform used by the prior art system of FIG. 1 for varying the amplitude of the sweeping signal.
Figure 2B:
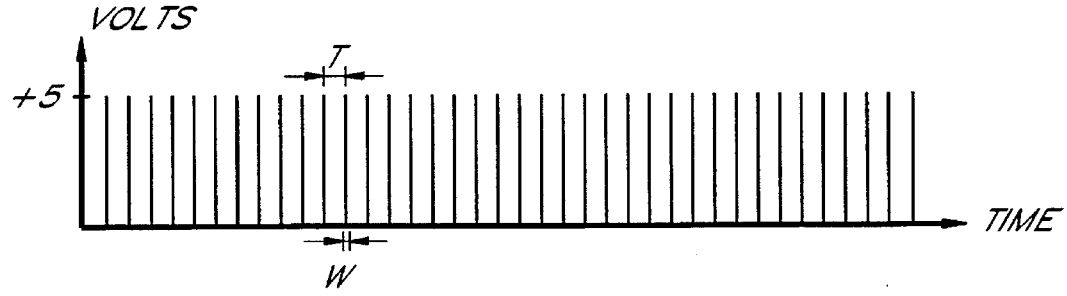
FIG. 2B (PRIOR ART)
FIG. 2B illustrates a sequence of pulses of constant voltage and pulse-width, used by the prior art system of FIG. 1 to strobe the discharge lamp on and off.
Figure 2C:
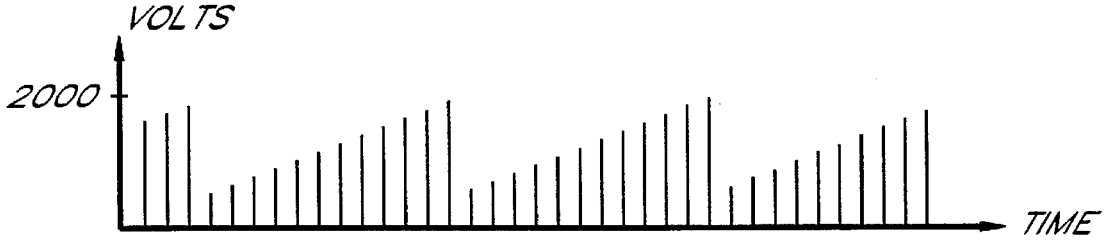
FIG. 2C (PRIOR ART)
FIG. 2C illustrates the sweeping signal applied to the electrodes of the discharge lamp of FIG. 1 for the signals of FIGS. 2A and 2B.

FIGS. 2A and 2B show the output signals of the sawtooth generator 110 and pulse generator 130 respectively. The output signal of the pulse generator has a constant pulse-width W. The corresponding sweeping signal which appears across the electrodes of the discharge lamp 100 is shown in FIG. 2C. The pulses of the sweeping signal typically range from about 500 to 1200 volts, in proportion to the voltage applied to the primary winding 122 of the transformer 120. For pulses of relatively low voltage, the region of ionization or "illumination region" extends for only a short distance from the internal electrode 104. For pulses of increasing magnitude the illumination region increases in size in the direction shown by the arrow in FIG. 1. Thus, the sequence of pulses of increasing voltage shown in FIG. 2C produces the desired sweeping effect. Other types of sweeping effects can be generated by using a different variable voltage waveform in place of the sawtooth waveform of FIG. 2A. For example, a triangular waveform or sinusoidal waveform can be used to produce a display which sweeps back and forth.

Assuming the pulse frequency remains constant, both the power consumption and luminance of the discharge lamp are proportional to the fixed pulse-width W in FIG. 2B. A pulse-width W can thus be selected according to the desired power consumption and luminance of a particular design. Typically, a pulse-width of about 25 μs and a pulse frequency of about 2 kHz are selected.

The applicant has now discovered that the desired sweeping effect can be generated without varying the amplitude of the pulses applied to the electrodes of the discharge lamp. Specifically, the applicant has discovered that a sweeping effect is produced if a sequence of voltage pulses of approximately constant amplitude and progressively increasing pulse-width (i.e., duration) is applied to the electrodes of the discharge lamp. A reverse sweeping effect (i.e., a sweeping decrease in the size of the illumination region) is similarly produced if a sequence of pulses of progressively decreasing pulse-width is applied to the electrodes of the discharge lamp.

In accordance with this discovery, a circuit is presented for generating a sweeping signal having pulses of approximately constant amplitude and variable pulse-width and for applying the variable-pulse-width sweeping signal to the electrodes of a discharge lamp. The circuit does not require a digital-to-analog converter or other means for generating a variable voltage waveform, and can thus be produced at a reduced cost in comparison to the prior art system described.

Figure 3A:
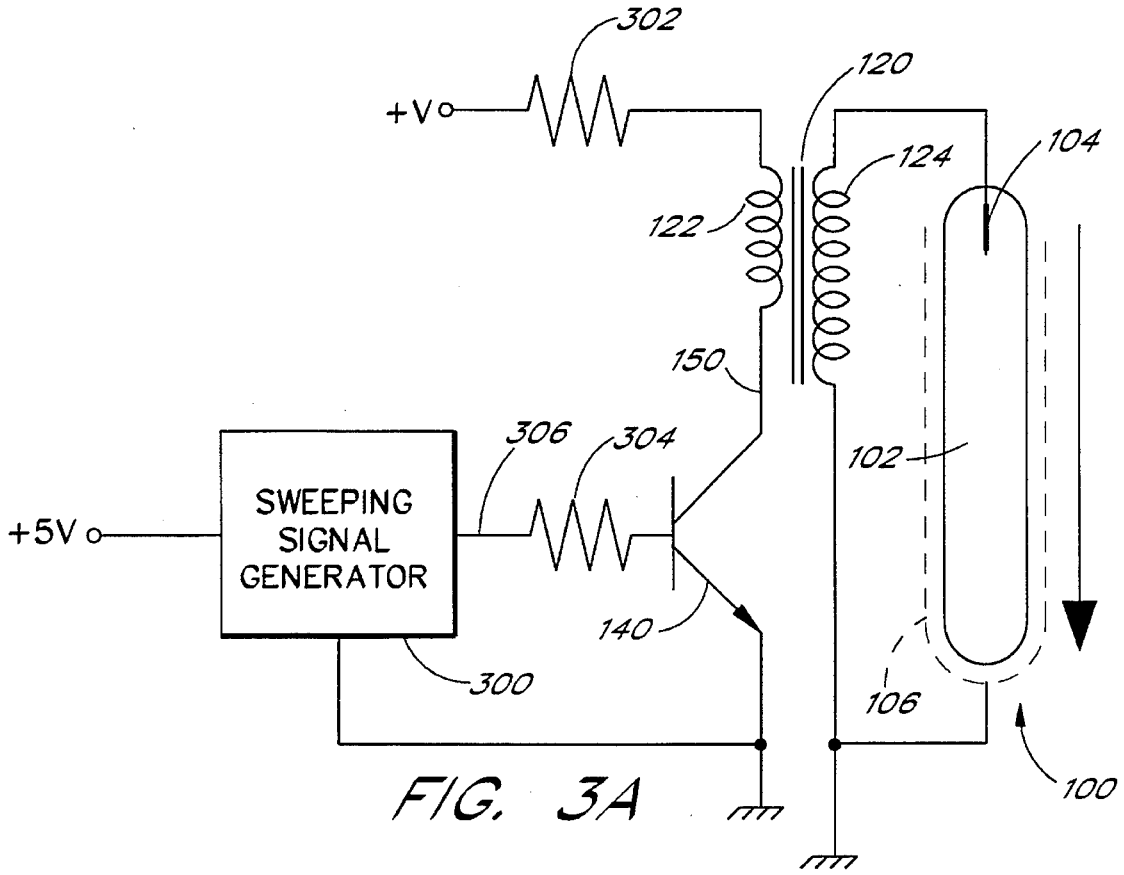
FIG. 3A illustrates a circuit in accordance with the present invention for generating a variable pulse-width sweeping signal and for applying the signal to the electrodes of a discharge lamp.

FIG. 3A illustrates a circuit in accordance with the present invention. The circuit differs from the prior art system of FIG. 1 in that the sawtooth waveform generator 110 has been eliminated, and the constant-width-pulse generator 130 has been replaced with a sweeping signal generator 300 capable of generating a periodic sequence of pulses of progressively increasing (or decreasing) pulse-width. The sweeping signal generator 300 is connected by a line 306 to a circuit comprising a constant voltage source +V, a resistor 302, the primary winding 122 of a step-up transformer 120, and a transistor 140. The secondary winding 124 of the step-up transformer 120 is connected to the internal electrode 104 and the external electrode 106 of a discharge lamp 100.

In the presently preferred embodiment, the resistor 302 has a resistance of 2.2Ω and a power rating of 2 watts. The resistor 304 has a resistance of 560Ω and a power rating of ¼ watt. The step-up transformer 120 has a primary winding 122 of 26¼ turns and a secondary winding of 3,500 turns. The transistor 140 is preferably an NPN switching transistor such as a 826F.

The external electrode 106 of the discharge lamp 100 may be composed of a tin oxide film. This film may be produced by the application of an aqueous solution of tin halide, as described above for the prior art. Alternatively, the external electrode may be produced by the application of an electrically-conductive paint. A tin chloride paint can be used for this purpose.

Figure 3B:
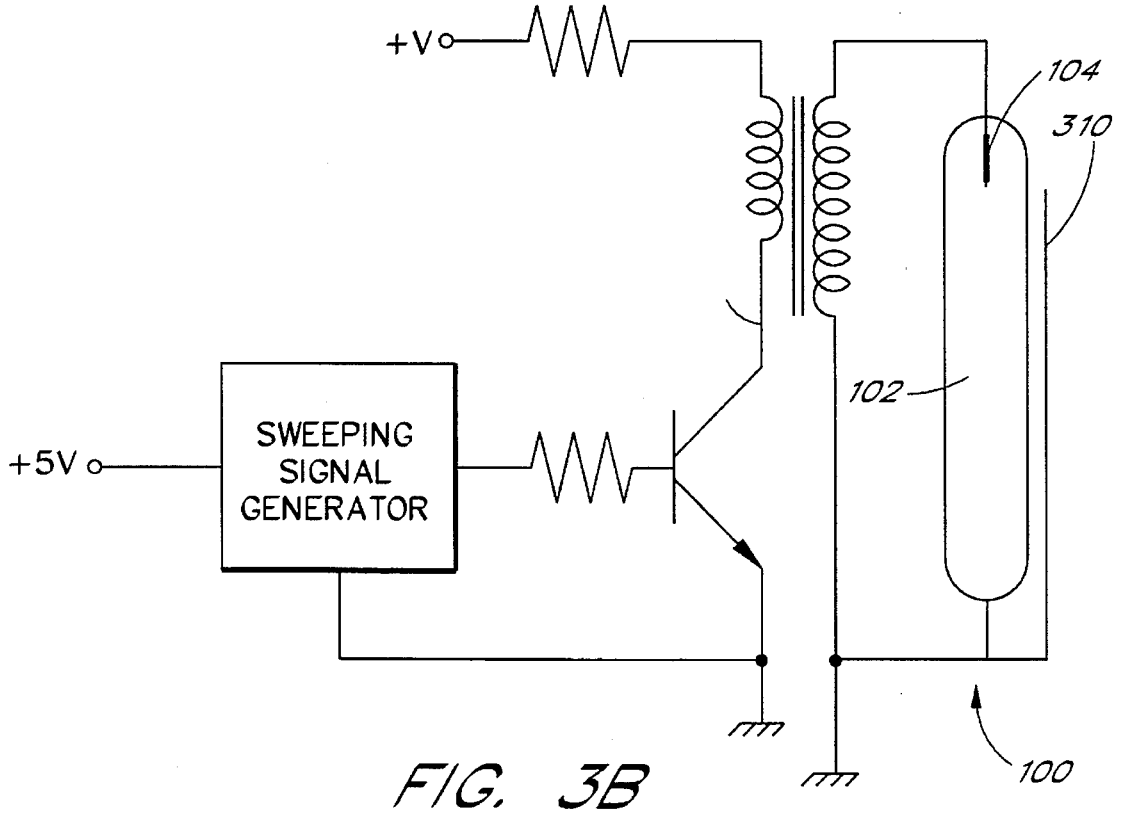
FIG. 3B illustrates an alternative embodiment of the discharge lamp that may be used with the circuit of FIG. 3A.

Another alternative embodiment of the discharge lamp 100 is illustrated in FIG. 3B. The external electrode is produced by running a conductive wire or rod 310 along the exterior surface of the discharge tube 102. The wire or rod 310 may be attached to the tube 102 by a heat resistant glue, for example, or may be held adjacent to the surface of the discharge tube (as shown) without touching the glass. To increase the surface area of the external electrode, multiple wires 310 can be used, or the wire 310 can be wrapped around the tube in a spiral or other fashion. The circuit for controlling the discharge lamp 100 of FIG. 3B is identical to the circuit shown in FIG. 3A.

The operation of the circuit shown in FIG. 3A will now be described. The sweeping signal generator 300 produces a logic-level sweeping signal (i.e., a bi-level signal, such as a TTL compatible signal, that switches between two voltage levels) on the line 306. The logic-level sweeping signal consists of a series of voltage pulses ("pulses") which vary in duration or "width." The logic-level pulses on the line 306 are reproduced at a higher voltage across the electrodes 104, 106 of the discharge lamp 100. The widths of the pulses of the sweeping signal are varied by the sweeping signal generator 500 to produce a variety of sweeping effects and other display effects.

Figure 4A:
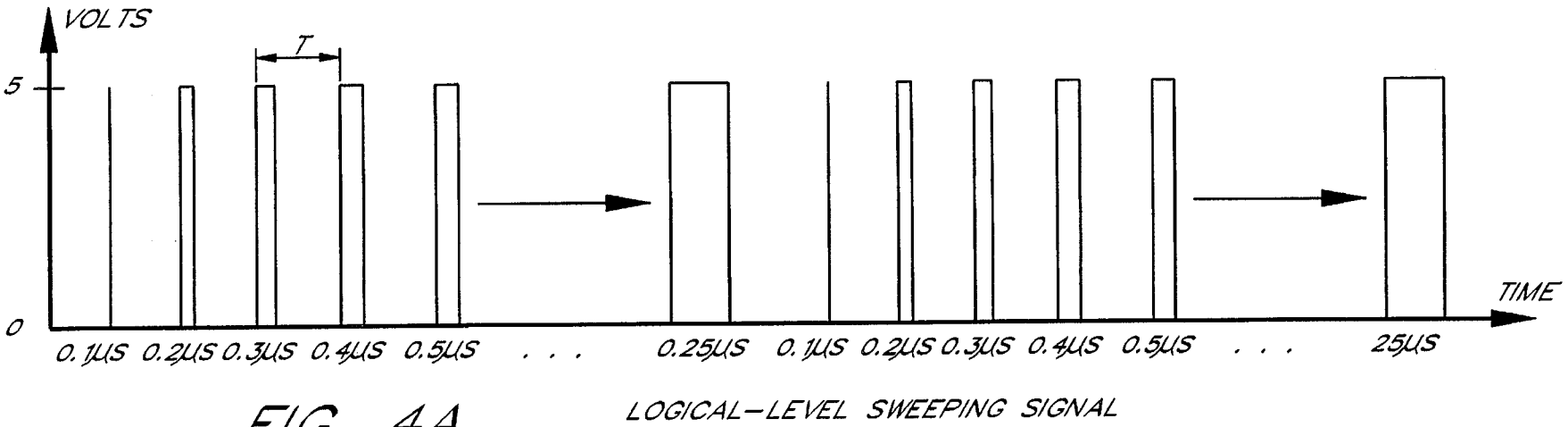
FIG. 4A illustrates a logic-level sweeping signal generated by the sweeping signal generator of FIG. 3A.

FIG. 4A illustrates an example of a sweeping signal generated by the sweeping signal generator 500. The sweeping signal consists of periodic sequences of logic-level pulses of increasing duration. In the example shown, the duration of the pulses is 0.1 μs at the beginning of each sequence, and successively increases at a rate of 0.1 μs/pulse until the pulses reach a width of 25 μs. The rising edges of successive pulses are separated by an approximately constant pulse period T as shown in FIG. 4A. In the preferred embodiment, a pulse period of approximately 500 μS is used, corresponding to a pulse frequency of approximately 2 kHz. The pulse frequency can be increased to increase the brightness (i.e., luminance) of the display, or can be decreased to reduce the brightness.

Figure 4B:
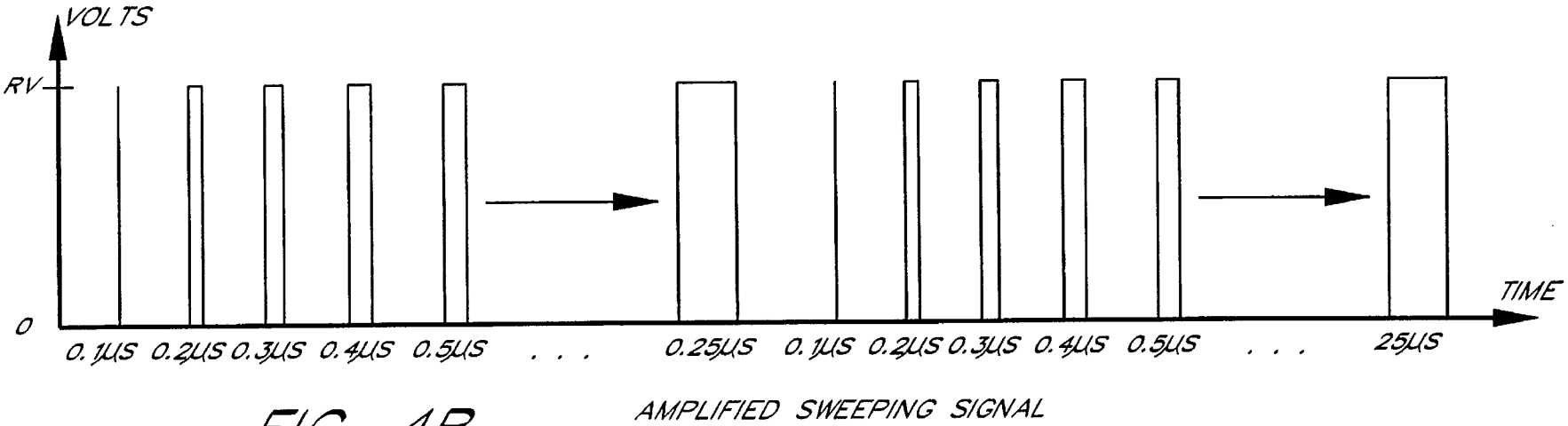
FIG. 4B illustrates an amplified sweeping signal which is applied to the discharge lamp for the logic-level sweeping signal of FIG. 4A.

Referring to FIG. 3A, the logic-level sweeping signal is applied to the base of the transistor 140 to cause the transistor 140 to switch "on" and "off," and to thereby close and open the circuit between the voltage source +V and ground. Assuming the voltage drop across the resistor 302 is approximately zero, the logic-level sweeping signal shown in FIG. 4A is replicated across the primary winding 122 of the transformer 120 at an amplitude of V volts. The signal across the primary winding 122 is reproduced at an amplified voltage across the secondary winding 124 of the transformer 120 as shown in FIG. 4B. This amplified sweeping signal is applied to the electrodes 104, 106 of the discharge lamp 100. The amplified sweeping signal has an amplitude of R X V, where R is the turns ratio of the transformer 120. In the preferred embodiment, R=3,500/26¼=133⅓, and V=13.8 volts, producing a pulse amplitude of approximately 1,840 volts.

The signal shown in FIG. 4B produces a display in which the illumination region initially extends for a relatively short distance from the internal electrode 104 and increases in size in the direction of the arrow in FIG. 3A as the pulses successively increase in duration. For the example sweeping signal shown, a maximum illumination region results when the pulse-width reaches its maximum duration of 25 μs. The illumination region then decreases to its minimum size, and increases in size with the next sequence of pulses of progressively increasing duration.

Although the pulses of the sweeping signal of FIGS. 4A and 4B are shown as increasing in duration with each successive pulse, it is not necessary for the pulse duration to increase with each successive pulse. For example, the desired sweeping effect can be produced using a pulse sequence wherein pulses are incremented in width on every tenth pulse. Thus, the terms "progressively increasing" and "progressively decreasing," as used herein to describe the pulse-width, are not intended to imply that the pulse-width must increase or decrease with successive pulses.

The sweeping signal shown in FIGS. 4A and 4B produces a sweep period of 250/2000=0.125 seconds. To increase the sweep period without changing the pulse frequency, the pulse-width can be incremented at a slower rate. For example, to increase the sweep period to 1.25 seconds, the pulse-width can be increased by 0.1 μs on every tenth pulse until the maximum width of 25 μs is reached.

It should be recognized from the foregoing that a variety of display effects can be produced by dynamically varying the pulse-width of the sweeping signal pulses. For example, the illumination region can be swept "back and forth" by applying a sequence of pulses of decreasing duration to the discharge lamp 100 followed by a sequence of pulses of increasing duration.

Advantageously, the logic-level sweeping signal of FIG. 4A is well-suited for generation using digital logic circuitry. To produce a display which can be program-controlled, digital logic circuitry can be used in combination with a simple microcontroller or microprocessor.

Figure 5:
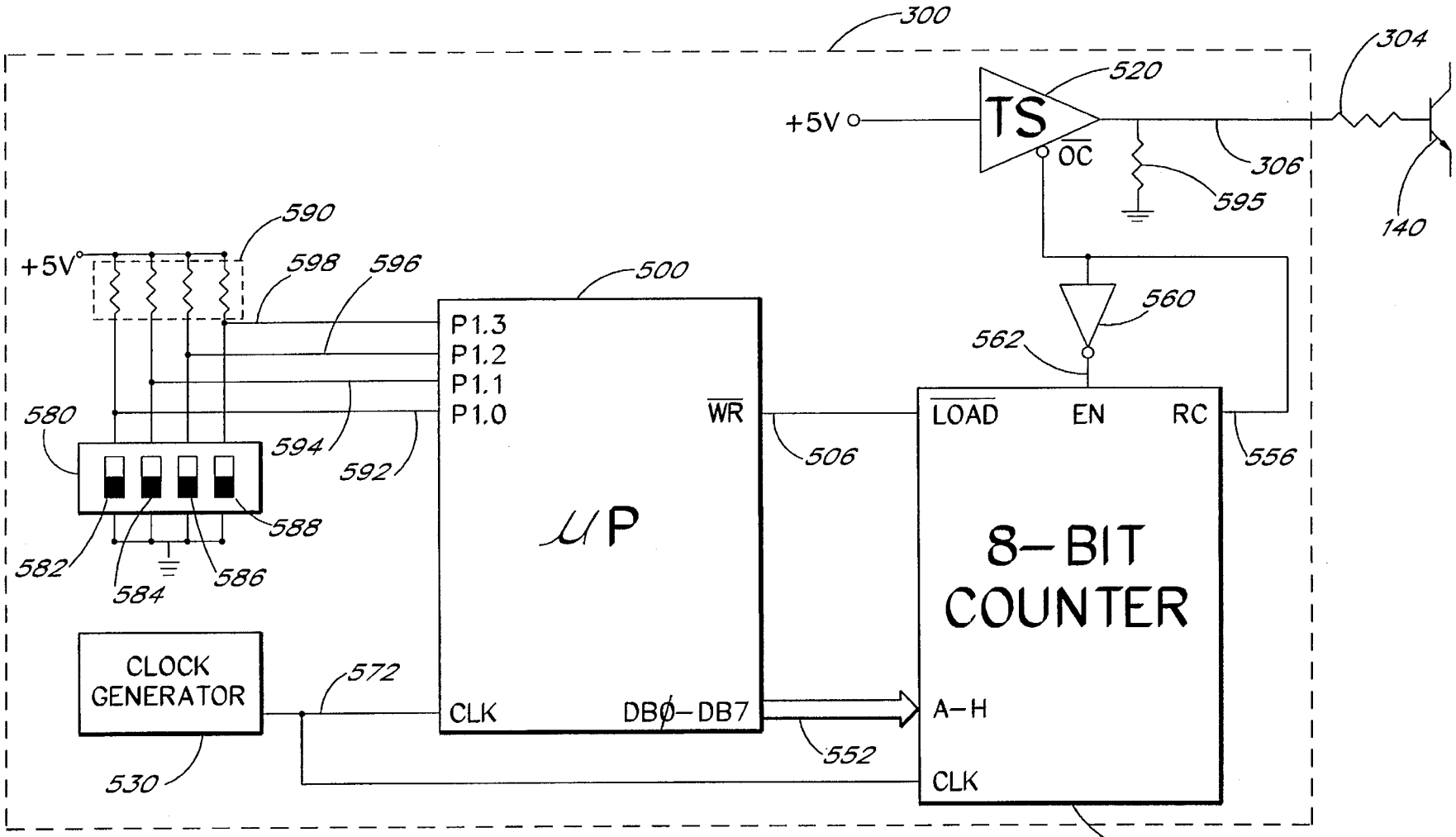
FIG. 5 is a circuit diagram for one embodiment of the sweeping signal generator of FIG. 3A.

FIG. 5 illustrates an embodiment of the sweeping signal generator 300. The sweeping signal generator 300 comprises a microprocessor (μP) 500, an 8-bit counter 510, a tri-state buffer 520, a clock generation circuit 530, an inverter 560, a dual-in-line package (DIP) switch 580, a set of pull-up resistors 590, and a pull-down resistor 595. In the preferred embodiment, the microprocessor 500 is an 8749 microcomputer available from Intel, which has an internal 8-bit event timer and an internal 8-bit programmable read-only memory ("ROM"). The microprocessor 500 has eight bi-directional data bus lines DB0–DB7 which form a data bus 552. The microprocessor 500 has an active-low write ($\overline{WR}$) line 506 which becomes active when the microprocessor 500 sends data to an external device on the data bus 552. The microprocessor 500 also has four port lines 592 (P1.0), 594 (P1.1), 596 (P1.2) and 598 (P1.3), which form the four low-order bits of an 8-bit port (port 1 of the 8749).

The microprocessor 500 is connected to the 8-bit counter 510 by the $\overline{WR}$ line 506 and the data bus 552. In the preferred embodiment the 8-counter 510 comprises two cascaded 74LS161 synchronous 4-bit binary counters, available from Texas Instruments and the like. The 8-bit counter 510 has an active-low load input ($\overline{LOAD}$) which is connected to the $\overline{WR}$ line 554 of the microprocessor 500. The 8-bit counter has eight data-input lines (A–H) which are connected to the data bus 552. The 8-bit counter has an active-high ripple carry (RC) output line 556 which becomes active when the count reaches a hexadecimal value of $FF_{16}$. The RC output line 556 is connected to the input of an inverter 560. The output of the inverter 560 is connected to the active-high enable (EN) input of the 8-bit counter 510 by the line 562.

The tri-state buffer 520 has a data input connected to a 5-volt source (+5V). The output of the tri-state buffer 520 is connected to the line 306, which is the sweeping signal output line of the sweeping signal generator 300. The line 306 is connected to the pull-down resistor 595. The line 306 is also connected to the resistor 304 as also shown in FIG. 3A. The tri-state buffer 520 has an active-low output control ($\overline{OC}$) input that tri-states the output when high, and enables the output when low. This $\overline{OC}$ input is connected to the RC output line 556.

The clock generator circuit 530 has a clock output line 572 which is connected to the clock (CLK) input of the 8-bit counter 510, and which is also connected to the clock (CLK) input to the microprocessor 500. In the preferred embodiment, the clock generator circuit 530 produces a 9 MHz clock signal.

The DIP switch 580 comprises four individual switches 582, 584, 586 and 588. Each switch 582, 584, 586, 588 is connected to ground at one end, and is connected to one of the four pull-up resistors 590 as shown. The pull-up resistors are connected to a 5-volt source (+5V) as shown. The switches 582, 584, 586 and 588 are connected to the port lines 592, 594, 596 and 598 as shown, such that each of the port lines 592, 594, 596 and 598 can be switched to either a logic-high level or a logic-low level by toggling the respective switch.

The operation of the sweeping signal generator 300 circuit will now be described. The purpose of the sweeping signal generator 300 is to generate a logic-level sweeping signal such as the variable pulse-width signal shown in FIG. 4A.

Initially, it may be assumed that the 8-bit counter 510 is disabled (i.e., the ripple carry output is high). The output of the tri-state buffer 520 is therefore tri-stated, and the line 306 is held low by the pull-down resistor 595. To generate a single pulse, the microprocessor 500 writes an 8-bit data value between $0_{16}$ and $FE_{16}$ to the 8-bit counter 510 by applying data to the bus 552 and by activating a write pulse on the $\overline{WR}$ line 506. The ripple carry (RC) output on the line 556 goes low as a result of the write operation, enabling the tri-state buffer 520 and thus causing the output line 306 to go high. The low level on the RC line 556 also causes the line 562 to go high, thereby enabling the counter 510. Once the enable (EN) input to the 8-bit counter 510 goes high, the counter 510 begins to count up on each occurrence of the clock signal on the line 572. Once a count of $FF_{16}$ is reached the ripple carry (RC) output line 556 goes high, thereby disabling the output of the tri-state buffer 520 and causing the output line 306 to go low. The high level on the ripple carry (RC) line 556 also causes the line 562 to go low, thereby disabling the counter 510.

The value loaded into the 8-bit counter 510 determines the amount of time the counter counts up before reaching a count $FF_{16}$, and thus determines the width of the pulse generated at the output of the tri-state buffer 520. If the counter is loaded with an initial count value of $0_{16}$, for example, the counter 510 will time out after 255/9 MHz= 28.3 μs, thereby producing a pulse of the same duration. Sequences of pulses of increasing pulse-width similar to those shown in FIG. 4A can thus be generated by loading the counter 510 with an initial count value of $FE_{16}$, and by decrementing the initial count value with successive load operations. For the example embodiment shown, each decrement of the counter 510 causes the pulse-width to increase by 1/9 MHz=0.11 μs. Successive counter load operations are spaced approximately 500 μs apart using the internal timer of the 8749, to thereby achieve the desired pulse frequency of 2000 Hz.

It will be recognized from the foregoing that the sweeping signal generator 500 circuit of FIG. 5 can vary the sweeping signal to produce a variety of display effects. For example, a sequence of constant-width pulses can be generated to leave the discharge lamp 100 in a partially or fully illuminated condition. Sequences can also be generated to produce sweeping effects in either direction as described above, or to temporarily turn the discharge lamp 100 off.

It will further be recognized that a simple assembly language program can be written to produce the desired sweeping signal to generate one or more of these display effects. For example, a program can be written to load an 8-bit register with an initial counter value, and to write the contents of the register whenever the internal timer reaches a predetermined value. The register value can be incremented (or decremented) between write operations until a maximum (or minimum) value is reached to thereby produce a forward (or backward) sweeping effect. A relatively slow sweeping effect can be produced by incrementing (or decrementing) the register, for example, after every tenth or twentieth write operation.

For applications where it is desirable to manually control the display, the DIP switch 580 can be used to select one of up to sixteen different display routines or display effects. For example, the program for the microprocessor 500 can be written to generate a forward sweep effect when the switches 582, 584, 586 and 588 are all in the "ON" position. To read the settings of the switches 582, 584, 586, 588 the microprocessor 500 merely performs a read of port 1. The switches can also be used by software to control the pulse frequency of the sweeping signal, and to thereby control the brightness of the display.

Figure 6:
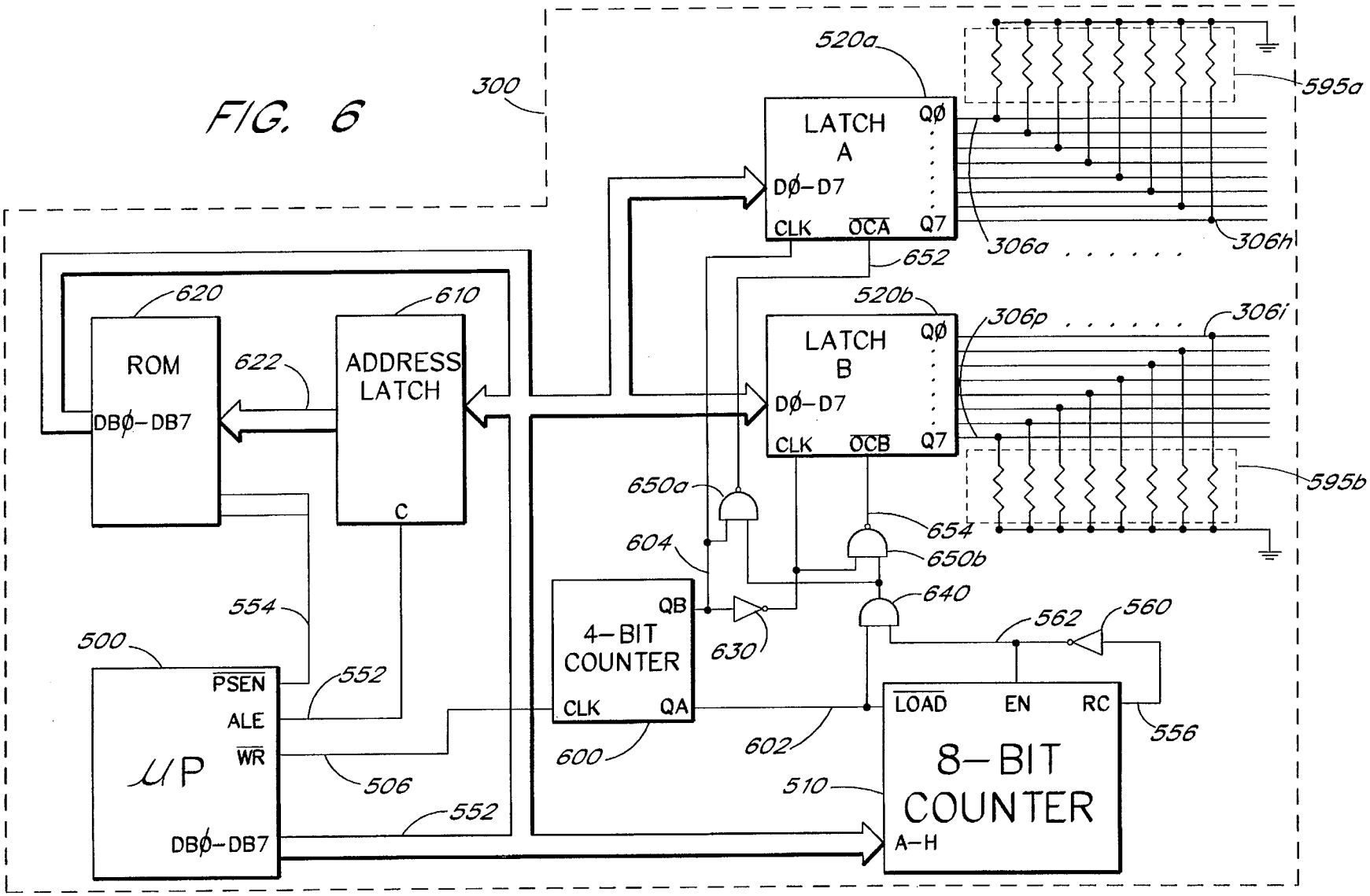
FIG. 6 is a circuit diagram for an alternative embodiment of the sweeping signal generator of FIG. 3A, capable of separately controlling the display of sixteen discharge lamps.

An alternative embodiment of the sweeping signal generator 300 is shown in FIG. 6. This alternative embodiment generates sixteen separate sweeping signals on sixteen output lines 306*a*–306*p*. This permits separate control of sixteen discharge lamps, thereby allowing different display effects to be produced with different discharge lamps. This embodiment can be used, for example, to individually "sweep on" the letters of a sign for a business, wherein each letter is formed by one or more discharge lamps.

Referring to FIG. 6, the circuit comprises the microprocessor 500, the 8-bit counter 510 and the inverter 560 of FIG. 5. The circuit also comprises an 8-bit latch 520*a* (LATCH A), an 8-bit latch 520*b* (LATCH B), a 4-bit binary counter 600, an 8-bit address latch 610, an 8-bit read-only memory (ROM) 620, an inverter 630, an AND gate 640, two NAND gates 650*a* and 650*b*, and pull-down resistors 595*a* and 595*b*. To simplify the drawing, the clock generator 530, DIP switch 580 and the pull-up resistors 590 of FIG. 5 are not shown.

The microprocessor 500 is now shown as having an address latch enable (ALE) output line 552 and a program store enable ($\overline{PSEN}$) output line 554. The ALE output line 552 becomes active on every clock cycle for the 8749. The $\overline{PSEN}$ output line 554 becomes active (low) when the 8749 performs an instruction fetch from the ROM 620. In the preferred embodiment, the counter 600 is a 4-bit binary up-counter such as a 74LS393. A power-on-reset circuit (not shown) is connected to a clear input (not shown) of the 4-bit counter to clear the count value when power is initially applied to the circuit 300. The least significant output (QA) line 602 of the 4-bit counter 600 is connected to the LOAD input of the 8-bit counter 510, and is also connected as a first input to the AND gate 640. The output of the inverter 560 is connected as a second input to the AND gate 640.

The second least significant output (QB) of the 4-bit counter 600 is connected to the clock (CLK) input to the latch 520*a* by the line 604. The line 604 is also connected as a first input to the NAND gate 650*a*, and as an input to the inverter 630. The output of the inverter 630 is connected to the clock (CLK) input of the latch 520*b*, and is also connected as a first input to the NAND gate 650*b*. The output of the AND gate 640 is connected as a second input to the NAND gate 650*a* and as a second input to the NAND gate 650*b*. The output of the NAND gate 650*a* is connected to the active-low output control ($\overline{OCA}$) input of the latch 520*a* by the line 652. The output of the NAND gate 650*b* is connected to the active-low output control ($\overline{OCB}$) input of the latch 520*b* by the line 654. The $\overline{OCA}$ and $\overline{OCB}$ inputs tri-state the outputs of the respective latches 520*a* and 520*b* when high.

The bus 552 from the microprocessor 500 is connected to the data inputs D0–D7 of the latch 520*a*, and to the data inputs D0–D7 of the latch 520*b*. The bus 552 is also connected as an input to the address latch 610. In the preferred embodiment, the address latch 610 is a 74LS373 D-type transparent latch. The enable (C) input of the address latch 610 is connected to the ALE line 552. The output of the address latch 610 is connected to the ROM 620 by a bus 622. The data outputs D0–D7 of the ROM 620 are connected to the bus 552.

The sixteen outputs 306*a*–306*p* of the latches 520*a*, 520*b* are connected to the pull-down resistors 595*a* and 595*b* such that the output lines of each latch are pulled low when the output control (OC) input 652, 654 of the respective latch is high. In the preferred embodiment, the logic-level sweeping signals on the output lines 306*a*–306*p* are also fed through a buffer (not shown) before being connected to individual discharge lamp circuits as illustrated in FIG. 3A.

The operation of the circuit of FIG. 6 will now be described. Following a reset of the circuit 300, the microprocessor 500 executes code out of its internal ROM. While running from the internal ROM, the microprocessor 500 reads the settings of the DIP switches 582, 584, 586 and 588 (FIG. 5). The settings of the DIP switches 582, 584, 586 and 588 specify one of 16 possible branch vectors for branching to a program address in the ROM 620. The settings of the DIP switches 582, 584, 586 and 588 thereby indicate one of 16 possible display routines.

Once a branch to the ROM 620 occurs, the microprocessor 500 places addresses for the ROM 620 on the bus 552 during instruction fetch cycles to fetch instruction data from the ROM 620. Addresses placed on bus 552 are latched by the address latch 610 in response to the ALE signal on the line 552, and are passed to the ROM 620 on the bus 622. In response to the signal on the $\overline{PSEN}$ line (which becomes active on instruction fetch cycles after the microprocessor 500 deasserts the ALE line 552 and stops driving the bus 552), the ROM 620 places the addressed instruction data on the bus 552, and the instruction data is read into the microprocessor 500. The instruction data specifies individual 8-bit patterns to be written to one of the two latches 520*a*, 520*b*.

In response to execution of the instruction data the microprocessor 500 performs a write of an 8-bit pattern. The pattern is written to either the latch 520*a* or the latch 520*b*, depending upon the state of the 4-bit counter 600. It may be assumed for illustrative purposes that the 4-bit counter has a count of $xx\mathbf{01}_2$ immediately preceding this write (i.e., QB=0 and QA=1). On the rising edge of the write pulse on the line 506, the 4-bit counter transitions to a count of $xx\mathbf{10}_2$. Thus, the latch 520*a* (LATCH A) is clocked and the pattern is written to the latch 520*a*. Since the 8-bit counter 510 is positive-edge triggered, the 8-bit counter 510 is not loaded during this write cycle.

Each bit of the 8-bit pattern written to the latch 520*a* specifies whether a pulse should be generated on one of the 8 output lines 306*a*–306*h*. For example, a binary pattern of $\mathbf{10101010}_2$ will cause a pulse to be generated on the lines 306*h*, 306*f*, 306*d* and 306*b*. At the time the write of the pattern is performed, the output control ($\overline{OCA}$) line 652 is high (inactive), assuming that the RC output line 556 is initially high. The outputs Q0–Q7 of the latch 520*a* are thus tri-stated, and the lines 306*a*–306*h* are held low by the pulldown resistors 595*a*.

Following the write of the pattern to the latch 520*a*, the microprocessor 500 performs a second write operation to load the 8-bit counter 510. This 8-bit counter value specifies the duration for the pulses to be generated on the selected lines 306*a*–306*h* (i.e., the lines 306*a*–306*h* for which a corresponding bit is set in the latch 520*a*). In response to the load operation, the RC output of the counter 510 goes low, enabling the counter 510. Since the 4-bit counter 600 transitions to a count of $xx\mathbf{11}_2$ during this second write operation, the $\overline{OCA}$ input line 652 to the latch 520*a* goes low (active). The pattern held by the latch 520*a* is thus placed on the lines 306*a*–306*h*.

Once the 8-bit counter reaches a count of $FF_{16}$ the RC output line 556 goes high, disabling the 8-bit counter 510 and causing the $\overline{OCA}$ input line 652 to go high. Thus, the pulses generated on the lines 306*a*–306*h* as specified by the pattern have pulse-widths determined by the initial count value.

After waiting long enough to ensure that the 8-bit counter has timed out (i.e., reached a count of $FF_{16}$), the microprocessor 500 writes another 8-bit pattern, and then writes a value to counter 510. However, since the 4-bit counter 600 has a count of $xx\mathbf{11}_2$ when this pattern write is performed, the pattern is written to the latch 520*b* (LATCH B), and the $\overline{OCB}$ line 654 becomes active.

As apparent from the foregoing, the circuit comprising the 4-bit counter 600, the inverter 630 and the gates 640, 650*a* and 650*b* has two purposes. The first purpose is to load the 8-bit counter on every other write operation. The second purpose is to alternate between the latch 520*a* and the latch 520*b* on every other pair of write operations.

Figure 7:
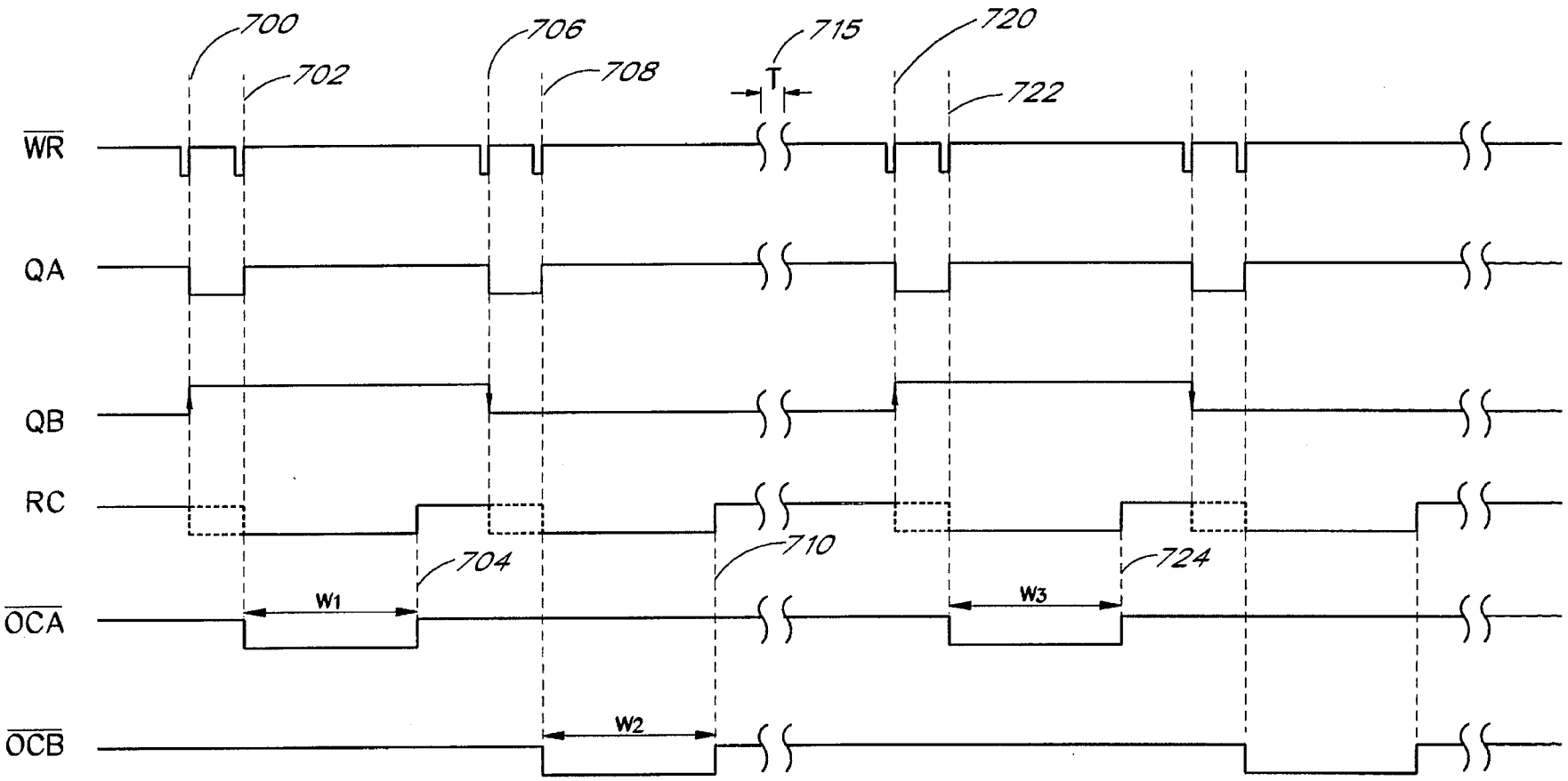
FIG. 7 is a timing diagram for the circuit shown in FIG. 6.

FIG. 7 is a timing diagram for the circuit of FIG. 6, showing the signals on the output lines $\overline{WR}$ 506, QA 602, QB 604 and RC 556 and the input lines $\overline{OCA}$ 652 and OCB 654. This timing diagram illustrates the normal operation of the system 300 after the microprocessor 500 has branched to the ROM 620. Initially it may be assumed that the two low-order bits of the 4-bit counter 600 are QB=0 and QA=1 (as shown). To place the counter 600 at this state following a reset of the system 300, the microprocessor 500 performs a single write operation to increment the count to $\mathbf{0001}_2$.

During the write pulse indicated by the reference line 700 the microprocessor 500 performs a write of a pattern. The rising edge of the write pulse on the $\overline{WR}$ line 506 causes the 4-bit counter 600 to increment. Thus, the QA output line 602 goes low and the QB output line 604 goes high. On the rising edge on the QB line 604 the pattern data is clocked into the latch 520*a* (LATCH A). The low value on the QA line 602 causes the $\overline{LOAD}$ input to the 8-bit counter 510 to go low, thus causing the ripple carry (RC) output of the 8-bit counter 510 to enter into a variable or unknown state.

During the following write cycle indicated by the reference line 702, an initial count value is written to the 8-bit counter 510. The rising edge on the QA line 602 causes the value on the bus 552 to be latched by the counter 510. Assuming the initial count value is less than $FF_{16}$, the RC output line 556 goes low and the counter begins to count. The low level on the RC line 556 in combination with the high level on the QB line 604 causes the $\overline{OCA}$ input line 652 to go low, enabling the output of the latch 520*a*. The OCA line 652 remains low for a time duration W1 which depends upon the initial count value loaded into the 8-bit counter 510. When the 8-bit counter 510 times out, the RC line 556 goes high, as indicated at the reference line 704. The high value on the RC line 556 causes the $\overline{OCA}$ line 652 to go high, disabling the output of the latch 520*a*.

The microprocessor 500 then performs another pattern write followed by counter write as indicated at the reference lines 706 and 708 respectively. On the rising edge of the write pulse indicated by the line 706, the QA and QB lines 602 and 604 go low. On the falling edge of the QB line 604 the inverter 630 produces a rising edge at the clock (CLK) input to the latch 520*b* (LATCH B), thereby clocking pattern data on the bus 552 into the latch 520*b*. On the following write cycle indicated by the reference line 708, the QA line 602 goes high causing the 8-bit counter 510 to be loaded. The resulting low level on the RC line 556 in combination with the low level on the QB line 604 causes the $\overline{OCB}$ line 654 to go low, enabling the output of the latch 520*b*. The $\overline{OCB}$ line 654 remains low until the RC line 556 goes high at the reference line 710, with the time duration W2 depending upon the initial count value loaded into the counter 510.

Following the pair of write operations indicated at the reference lines 706 and 708 the microprocessor 500 waits for a time duration T, as indicated by the reference number 715. The time duration T is controlled by the internal timer of the microprocessor 500, and is approximately equal to the pulse period T shown in FIG. 4A. After waiting for a time duration T the microprocessor 500 repeats the process, performing write operations at the reference lines 720 and 722 to enable the outputs of the latch 520*a* for a duration W3.

As illustrated by the foregoing, the circuit of FIG. 6 can be used to generate separate sweeping signals to control sixteen discharge lamps. The circuit can, for example, generate sweeping signals on the lines 306*a*–306*h* to produce a forward sweeping effect while generating sweeping signals on the lines 306*i*–306*p* to produce a reverse sweeping effect. Or, discharge lamps connected to the lines 306*a*–306*p* can be "swept on" one-after-another in sequential fashion.

Figure 8:
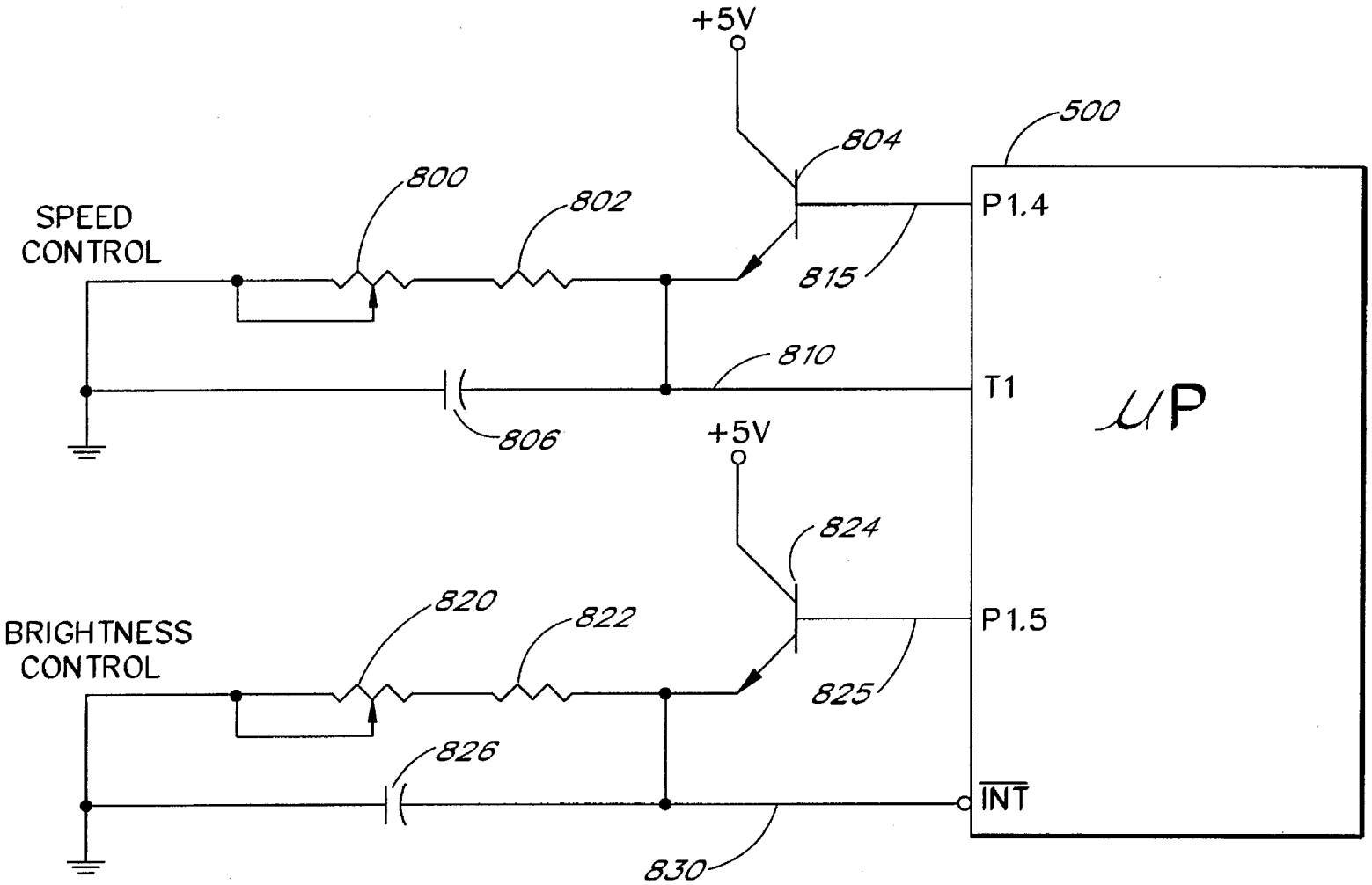
FIG. 8 is a circuit diagram for a speed control circuit and a brightness control circuit that can be added to the embodiments of FIGS. 5 and 6.

FIG. 8 illustrates a speed control circuit and a brightness control circuit that can be added to the embodiments of FIGS. 5 and 6 to provide a higher degree of control over the sweep speed and the brightness (i.e., pulse frequency) of the display. Referring to FIG. 8, a potentiometer 800 is connected between ground and a first end of a resistor 802. The second end of the resistor 802 is connected to a node 810. A capacitor 806 is connected between ground and the node 810. An NPN transistor 804 has a collector connected to a 5-volt (+5V) source, and an emitter connected to the node 810. The base of the transistor 804 is connected to a P1.4 (port 1, bit 4) input/output of the microprocessor 500 by a line 815. The node 810 is connected to a T1 input to the microprocessor 500. The potentiometer 800, the resistor 802, the transistor 804 and the capacitor 806 form a speed control circuit for controlling the sweep speed.

A similar circuit to the speed control circuit is used as a brightness control circuit. A potentiometer 820 is connected between ground and a first end of a resistor 822. The second end of the resistor 822 is connected to a node 830. A capacitor 826 is connected between ground and the node 830. An NPN transistor 824 has a collector connected to a 5-volt (+5V) source, and an emitter connected to the node 830. The base of the transistor 824 is connected to a P1.5 (port 1, bit 5) input/output of the microprocessor 500 by a line 825. The node 830 is connected to the active-low interrupt ($\overline{INT}$) input to the microprocessor 500.

In the preferred embodiment the resistors 802 and 822 each have a resistance of 4.7kΩ, the capacitors 806 and 826 each have a capacitance of 0.1 μF, the potentiometer 800 varies from 0Ω to 20kΩ, and the potentiometer 820 varies from 0Ω to 10kΩ.

The operation of the speed control circuit will now be described. Following a reset of the system 300, the microprocessor 500 drives the line 815 high by performing a write to port 1 (with a logic one value for bit 4). The microprocessor 500 also starts the internal timer. The high value on the line 815 during the write operation causes the transistor 804 to switch ON, thereby causing the capacitor 806 to charge to a voltage of 5 volts. The node 810 is thus at a level of 5 volts (i.e., a logic one level) immediately following the write to port 1. Following the write to port 1, the capacitor discharges through the resistor 802 and the potentiometer 800. The microprocessor 500 measures the discharge time by repetitively reading the T1 input line until a logic zero level is detected. Once a logic zero level is detected, the microprocessor 500 reads the internal timer to determine the discharge time. The program then uses this timer value as a program variable to control the speed at which pulses are incremented (or decremented) in pulse-width, and to thereby control the sweep speed of the display. A user can thereby control the sweep speed by adjusting the potentiometer 800 (prior to a reset) to vary the R-C time constant of the speed control circuit.

The brightness control circuit is used by the microprocessor 500 in a similar manner. The microprocessor 500 starts the internal timer, and writes a high value on the P1.5 output line 825. Following the write operation, the microprocessor enables interrupts. The high level on the line 825 during the write operation causes the transistor 824 to switch ON, and thus causes the capacitor 826 to charge to 5 volts. As the capacitor 826 discharges through the resistor 822 and the potentiometer 820, the voltage of the node 830 decreases. Once the voltage of the node 830 reaches a logic zero level, an interrupt is generated. An interrupt service routine disables interrupts and reads the internal timer. The value of the internal timer is used to adjust the pulse frequency, and to thereby adjust the brightness of the display. A user can thereby control the brightness by adjusting the potentiometer 820 to vary the R-C time constant of the brightness control circuit.

The software routines for measuring the time constants of the speed control and brightness control circuits preferably reside in the internal ROM of the microprocessor 500. Each routine is preferably executed once following a reset. Following execution of both routines, a branch to the ROM 620 is taken and routines are executed to generate sweeping signals using the measured variables to control the sweep speed and the pulse frequency. It is also possible to measure the time constants of the speed control and brightness control circuits on a periodic basis, to avoid having to reset the system every time a potentiometer adjustment is made.

It should be understood that the above-described circuits for generating logic-level, variable pulse-width sweeping signals have been presented by way of example only. As will be recognized by one skilled in the art, numerous alternative circuits and methods are possible for generating a variable pulse-width signal. For example, an application-specific integrated circuit (ASIC) can be used that integrates counter and control logic similar to that of FIGS. 5 and 6 onto a single chip. Thus, the specific exemplary embodiments of the sweeping signal generator 300 that have been provided are not intended to limit the scope of the present invention, and are presented merely to illustrate several exemplary circuits and methods for practicing the present invention. Accordingly, the breadth and scope of the present invention should be defined only in accordance with the following claims and their equivalents.

What is claimed is:

1. A circuit for producing a sweeping illumination effect, comprising:

a discharge lamp having a discharge tube and first and second electrodes, at least one of said electrodes extending along an outer surface of said discharge tube;

a transformer, having a primary winding and a secondary winding, said secondary winding being connected to said electrodes of said discharge lamp;

a constant voltage source connected to the first end of said primary winding of said transformer;

a switch connected between ground and the second end of said primary winding of said transformer, said switch permitting a circuit containing said primary winding to be opened and closed so as to generate a pulse signal across said secondary winding of said transformer; and a sweeping signal generator that generates a logic-level sweeping signal having variable-width pulses, said logic-level sweeping signal applied to said switch, said variable-width pulses of said logic-level sweeping signal opening and closing said switch to thereby generate a variable pulse-width sweeping signal across said secondary winding of said transformer, said sweeping signal generator automatically varying widths of said variable-width pulses so as to cause an illumination region of said discharge lamp to change with a sweeping effect.

2. The circuit as defined in claim 1, wherein said variable-width pulses of said logic-level sweeping signal progressively increase in pulse-width over a period of time to cause said illumination region of said discharge lamp to increase with a sweeping effect over said period of time.

3. The circuit as defined in claim 1, wherein said variable-width pulses of said logic-level sweeping signal progressively increase in pulse-width from a minimum pulse-width to a maximum pulse-width to cause said illumination region of said discharge lamp to increase from a minimum size to a maximum size.

4. The circuit as defined in claim 1, wherein said switch comprises a switching transistor.

5. The circuit as defined in claim 1, wherein said sweeping signal generator comprises:

a counter that counts from an initial count value to a predetermined count value to control said widths of said variable-width pulses; and a microprocessor that periodically loads said counter with said initial count value, said initial count value specifying a width of a variable-width pulse.

6. The sweeping signal generator as defined in claim 5, wherein a first transition of said variable-width pulse is generated when said microprocessor loads said counter with said initial count value, and a second transition of said variable-width pulse is generated when said counter reaches said predetermined count, said first transition and said second transition forming the beginning and the end of said variable-width pulse.

7. The circuit as defined in claim 1, wherein said sweeping signal generator comprises an application specific integrated circuit.

8. A system for producing a sweeping illumination effect, comprising:

a discharge lamp, said discharge lamp comprising a discharge tube and first and second electrodes;

a sweeping signal generator that generates sequences of logic-level pulses of variable pulse-width; and an amplifier circuit that amplifies said logic-level pulses to generate sequences of pulses of approximately constant amplitude and variable pulse-width, said amplifier circuit having an output connected to said first and second electrodes of said discharge lamp;

wherein said sweeping signal generator automatically varies widths of said logic-level pulses to thereby vary a size of an illumination region of said discharge lamp.

9. The system as defined in claim 8, wherein said sweeping signal generator comprises a microprocessor that generates said logic-level pulses, and a counter that controls the widths of said logic-level pulses.

10. The system as defined in claim 9, wherein said amplifier circuit comprises a step-up transformer.

11. The system as defined in claim 8 wherein said first electrode is an internal electrode and said second electrode is an external electrode, said external electrode comprising a tin oxide coating on an outer surface of said discharge tube.

12. The system as defined in claim 8 wherein said first electrode of said discharge lamp comprises an internal electrode and said second electrode comprises an external electrode, said external electrode comprising a conductive paint on an outer surface of said discharge tube.

13. The system as defined in claim 8 wherein said first electrode comprises an internal electrode and said second electrode comprises an external electrode, said external electrode comprising a conductor which extends along an outer surface of said discharge tube.

14. A method for providing a sweeping display of a discharge lamp, comprising the steps of:

(a) automatically generating a logic-level sweeping signal having a sequence of pulses of progressively increasing or progressively decreasing pulse-width;

(b) amplifying said logic-level sweeping signal to produce an amplified sweeping signal having a sequence of pulses of approximately constant amplitude and progressively increasing or progressively decreasing pulse-width; and (c) applying said amplified sweeping signal to the electrodes of said discharge lamp to thereby cause an illumination region of said discharge lamp to progressively increase or decrease in size with a sweeping effect.

15. The method as defined in claim 14, wherein said step (b) comprises applying said logic-level sweeping signal to a primary winding of a step-up transformer.

16. A method for providing a sweeping display of a discharge lamp, comprising the steps of:

providing a discharge lamp, said discharge lamp comprising a discharge tube and first and second electrodes, at least one of said electrodes extending along an outer surface of said discharge tube so as to define a variable-size illumination region;

generating sequences of pulses of variable pulse-width, said step of generating comprising automatically varying widths of said pulses over a sweep period; and applying said sequences of pulses to said electrodes of said discharge lamp to illuminate said discharge lamp, said illumination region of said discharge lamp varying in size during said sweep period as said widths of said pulses are varied.

17. The method as defined in claim 16, wherein said step of generating comprises progressively increasing said widths of said pulses over said sweep period to progressively increase the size of said illumination region during said sweep period.

18. The method as defined in claim 16, wherein said step of generating comprises progressively decreasing said widths of said pulses over said sweep period to progressively decrease the size of said illumination region during said sweep period.

19. The circuit as defined in claim 1, wherein said sweeping signal generator programmably varies said widths of said variable-width pulses.

20. The circuit as defined in claim 1, wherein said first electrode is inside said discharge tube, and wherein said second electrode extends along an outer surface of said discharge tube in a direction generally away from said first electrode.

21. The system as defined in claim 8, wherein at least one of said electrodes extends along an outer surface of said discharge tube.

22. The system as defined in claim 8, wherein said first electrode is inside said discharge tube, and wherein said second electrode extends along said outer surface of said discharge tube in a direction generally away from said first electrode.

23. The system as defined in claim 8, wherein said sweeping signal generator automatically increments said widths of said logic-level pulses during a sweeping period to cause said illumination region of said discharge lamp to increase in size with a sweeping effect during said sweeping period.

* * * * *